United States Patent [19]

Safrit et al.

[11] 4,263,793

[45] Apr. 28, 1981

[54] DRESS WEIGHT TUBE SOCK

[75] Inventors: Sam C. Safrit, Pfafftown; Harper Shields; William H. Coble, both of Burlington; Roscoe M. Farrell, Pittsboro, all of N.C.

[73] Assignee: Kayser-Roth Hosiery, Inc., Burlington, N.C.

[21] Appl. No.: 25,793

[22] Filed: Apr. 2, 1979

Related U.S. Application Data

[62] Division of Ser. No. 939,261, Sep. 7, 1978, Pat. No. 4,172,370.

[51] Int. Cl.[3] ..... A41B 11/02; D04B 9/46

[52] U.S. Cl. ..... 66/185; 66/178 A; 66/202; 2/239

[58] Field of Search ..... 66/185, 186, 187, 178, 66/178 A, 194, 180, 19, 92, 202, 184; 2/239

[56] References Cited

U.S. PATENT DOCUMENTS

| | | | |
|---|---|---|---|
| 2,144,563 | 1/1939 | Davis | 66/182 |
| 2,154,155 | 4/1939 | Fleisher | 66/194 |
| 2,370,450 | 2/1945 | Clarke | 66/188 |
| 2,400,637 | 5/1946 | Fregerlle | 66/82 |
| 2,436,904 | 3/1948 | Shea | 66/186 |
| 2,710,527 | 6/1953 | Radin | 66/194 |
| 3,250,095 | 5/1966 | Bird | 66/178 |
| 3,274,804 | 9/1966 | Thorneburg et al. | 66/186 |
| 3,793,851 | 2/1974 | Thorneburg | 66/187 |
| 4,104,892 | 8/1978 | Thorneburg | 66/178 |

OTHER PUBLICATIONS

Wignall, H., "Hosiery Technology", Knitted Outerwear, Assoc, 1968, N.Y., pp. 63–64.

*Primary Examiner*—Ronald Feldbaum
*Attorney, Agent, or Firm*—Bell, Seltzer, Park & Gibson

[57] ABSTRACT

This tube sock is of a medium or dress weight so that the sock may be comfortably worn with dress shoes and includes very long and fine terry loops in the heel and sole area to provide the sock with cushion and comfort characteristics of the type normally provided in heavy weight athletic type socks. The sock is knit on a fine gauge machine of the type normally employed in knitting ladies' sheer hosiery and panty hose, usually provided with 400 needles. The sock is knit on every other or alternative needles so that it contains only 200 wales instead of the normal 400 wales usually contained in ladies' sheer hosiery articles. The terry loops formed in the heel and sole area are formed on dial instruments projected outwardly over an idle needle so that unusually long terry loops are formed of a fine cotton yarn which are three to five times as long as the stitch loops formed of the body yarn.

3 Claims, 5 Drawing Figures

DRESS WEIGHT TUBE SOCK

This a division of application Ser. No. 939,261, filed Sept. 7, 1978 now U.S. Pat. No. 4,172,370.

FIELD OF THE INVENTION

This invention relates to a dress weight tube sock which combines the fit and comfort of an athletic type sock with the lighter weight and appearance of a dress sock.

BACKGROUND OF THE INVENTION

Hosiery articles are normally divided into three general types, namely, (1) heavy weight or athletic type socks which are either of tube construction or provided with a reciprocated heel pocket, (2) medium or dress weight socks which generally include a reciprocated heel pocket, and (3) lightweight or sheer hosiery which may be knit either with or without a reciprocated heel pocket. All three of these types of hosiery are knit on circular hosiery knitting machines having $3\frac{3}{4}$ or 4 inch diameter needle cylinders. The heavy weight or athletic type socks are usually knit on coarse gauge circular knitting machines having in the range of about 84 to 120 needles and this type of sock is usually worn with boots, casual shoes, tennis shoes, and the like. In many cases, this type of sock is provided with terry loops to provide a "cushion" sole. Medium or dress weight type socks are usually knit on medium gauge knitting machines having a range of about 132 to 220 needles and this type of sock, frequently of rib-knit construction, is usually worn with dress shoes. Lightweight hosiery, such as ladies' sheer stockings and panty hose, are usually knit on fine gauge machines having about 400 needles. Thus, the three general types of hosiery are normally knit on different types of circular hosiery knitting machines with needles differing as to gauge, number and spacing. Thus, it is necessary for a manufacturer to purchase and have available three types of knitting machines if it desires to produce all three types of hosiery articles. For example, the thicker, heavier yarn customarily used for athletic socks, and for cushion soles, cannot be easily accommodated in the fine gauge high speed 400 needle machines used for ladies' sheer hosiery and panty hose. On the other hand, fine denier nylon or the like as used in ladies' sheer hosiery or panty hose is totally unsuitble for the coarser gauge wider spaced needles used in knitting heavier athletic type socks.

Moreover, the heavy weight or athletic type socks constructed for comfort and/or warmth are too heavy to be worn with dress shoes, particularly if knit with cushion soles or feet, and medium or dress weight socks, while neater in appearance and style, do not provide the comfort cushion of the athletic type socks.

SUMMARY OF THE INVENTION

With the foregoing in mind, it is an object of the present invention to provide a dress weight tube sock combining the fit and comfort of an athletic sock with the lighter weight and neater finer appearance of a dress sock, which dress weight tube sock may be economically knit on a fine gauge machine of the type normally employed in knitting ladies' sheer hosiery and panty hose. The hosiery of the present invention is of a medium or dress weight with small stitch loops so that it may be comfortably worn with dress shoes, yet it includes a soft staple yarn for comfort and fine terry loops in the heel and foot areas to produce a cushion and comfort characteristic of the type normally provided in heavy weight athletic type socks, but without the bulk of such conventional socks.

In accordance with the present invention, the dress weight tube sock combines a stretchable synthetic body yarn and a nonstretchable lightweight auxiliary yarn knit in plated relationship throughout at least the leg portion with the lightweight auxiliary yarn being formed into unusually long terry loops in the heel area and in other desired portions of the foot, such as the sole, toe and lower portion of the instep. The auxiliary yarn is preferably a lightweight cotton yarn within the range of about 40 to 60 single count and the stretchable synthetic body yarn is preferably multifilament nylon within the range of about 100 to 200 denier. The cotton auxiliary yarn is plated on the inside of the stretchable nylon body yarn so that the cotton yarn is positioned against the foot and leg of the wearer to provide absorption and comfort while the nylon body yarn positioned on the outer surface of the sock results in a neater finer surface appearance, stretch, leg comformity and fit and wear resistance.

The sock of the present invention is most advantageously knit on a fine gauge ladies' hosiery circular knitting machine of the type normally provided with approximately 400 latch needles of about 75 gauge. However, in accordance with the present invention, the sock is knit on every other needle so that it contains only 200 wales instead of the normal 400 wales contained in ladies' sheer hosiery articles of the type normally knit on this type of machine. Thus, fine gauge needles are used, but they are spaced approximately twice as far apart as is normal. Instead of the sheer filament yarns customarily used on machines of this type, a lightweight staple yarn, preferbly cotton, is plated with a stretchable thermoplastic such as nylon throughout the leg. The staple yarn is formed into terry loops in desired areas of the heel and sole area in a novel manner to produce extra long lightweight terry for comfort without bulk. This is accomplished by using the dial instruments on this type machine and projecting them outwardly in the space over idle needles and drawing the staple yarn over the dial instruments between adjacent active fine gauge needles so that unusually long and uniform terry loops are formed of the fine cotton yarn. The terry loops are preferably at least five times as long as the stitch loops formed of the body yarn to provide a very fine and lightweight "cushion" along the lower portion of the foot of the wearer.

In a preferred construction of the sock of the present invention, the leg and foot portions are knit of a 140 denier stretchable nylon body yarn and a nonstretchable auxiliary cotton yarn having a single cotton count of 50. The sock is knit on an eight feed ladies' hosiery machine which has been modified to knit at four feeds. Every other needle of the machine is maintained in a lowered inactive position so that the stitch loops are formed on 200 needles and the resulting sock is of sufficiently lightweight construction to be worn with dress shoes of the type which are normally worn with medium weight dress socks.

BRIEF DESCRIPTION OF THE DRAWINGS

Other objects and advantages will appear as the description proceeds when taken in connection with the accompanying drawings, in which.

DESCRIPTION OF THE ILLUSTRATED EMBODIMENT

Figure 1:
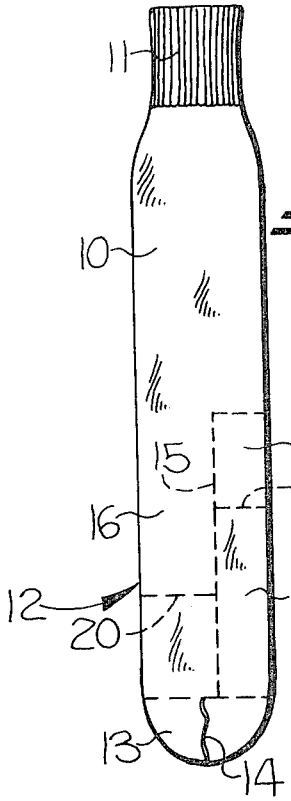
FIG. 1 is an elevational view of the sock in accordance with the present invention in flattened condition.
Figure 2:
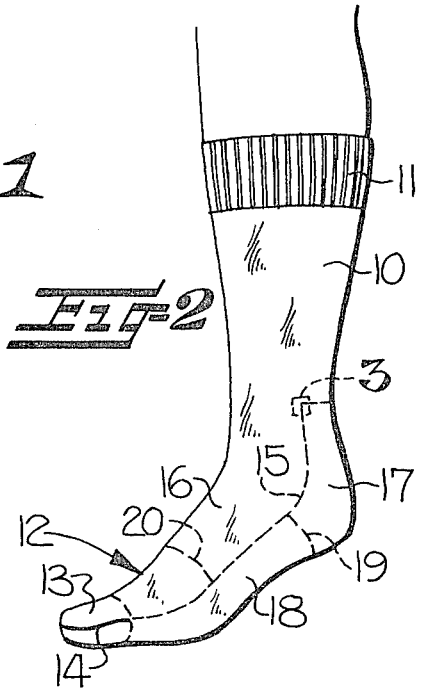
FIG. 2 is a perspective view of the present sock as it appears when positioned on the foot of a wearer.

The dress weight tube sock of the present invention has the comfort characteristics of an athletic sock but is sufficiently light in weight and appearance to be worn as a dress sock. As illustrated in FIGS. 1 and 2, the sock includes a leg portion 10 having an upper elastic cuff 11 and a foot portion broadly indicated at 12. The leg and foot portions contain about 180 to 200 wales and preferably contain 200 wales. The foot portion 12 includes a closed toe 13 which is illustrated as the well-known "fish mouth" type toe closed by a seam 14 extending around the toes of the wearer. The dotted line 15 indicates the circumferential division of the foot portion 12 into upper and lower portions with the upper portion defining an instep portion 16 and the lower portion defining a heel patch or area 17 and a sole area 18 extending between the heel area 17 and the toe 13. The instep 16 extends adjacent the heel area 17 and sole area 18 and to the toe 13. The dotted line 19 indicates the lower end of the heel area 17 and the upper end of the sole area 18 and it is preferred that terry loops be provided in the inner surface of the heel area 17, the sole area 18, the toe 13 and the lower portion of the instep 16, that portion below the dotted line 20.

Ordinarily, if terry loops were formed in the top or instep area of the foot, as in some athletic socks, the resulting bulk would necessitate a larger shoe size and would make the sock impractical for dress wear. By using the fine gauge, extra long lightweight terry loops formed in accordance with this invention, a comfortable toe pocket of terry may be provided, cushioning the upper and lower portions of the toes and foot without unduly increasing the bulk of the sock. Since the lack of bulk permits this sock to be worn with dress shoes of standard size, it is preferred to stop the terry midway of the instep, as indicated at 20, so that differences in the fabric will not be visible when low-cut or slipper type shoes are worn. The method of knitting the sock and forming the terry loops will be presently described.

Figure 4:
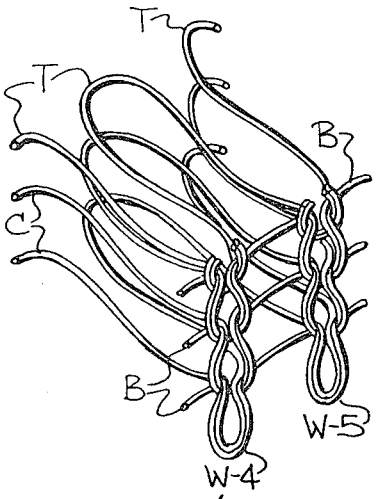
FIG. 4 is greatly enlarged fragmentary cross-sectional isometric view taken substantially along the line 4—4 in FIG. 3.

The cuff 11 may be of any of the well-known types of cuff which are normally formed on socks, either knee-high or ankle-high socks. The leg portion 10 and foot portion 12 are knit of a stretchable synthetic body yarn of about 100 to 200 denier, preferably 140 denier nylon which has been textured to impart stretch characteristics thereto, indicated at B in FIGS. 3–5. For example, a 140 denier, 100 filament, nylon textured by false twisting in an S direction has been found satisfactory.

Figure 3:
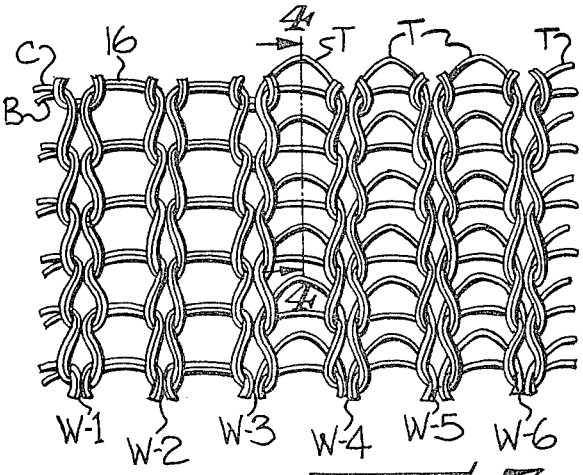
FIG. 3 is a greatly enlarged fragmentary elevational view of a small portion of the fabric enclosed in the dotted rectangle 3 in FIG. 2.

A nonstretchable auxiliary yarn, indicated at C, is knit in plated relationship with the body yarn B, as illustrated in the left-hand portion of FIG. 3 (wales W-1, W-2 and W-3), throughout the leg portion 10 and throughout the portion of the instep 16 adjacent the heel area 17, down to the dotted line 20.

The auxiliary yarn is a soft lightweight staple yarn such as Orlon acrylic or cotton. Not only does this provide a soft absorbent yarn next to the skin of the wearer, but the staple fibers fill the interstices of the stitch loops and modify the otherwise hard slick appearance and hand of the nylon body yarn, resulting in a soft hand, and a dull even appearance. The auxiliary yarn C is preferably cotton, of about 40 to 60 single count, preferably 50 single count.

The auxiliary yarn C is also knit in plated relationship with the body yarn B and forms terry loops T at least throughout the heel area 17 and sole area 18, as illustrated in the right-hand portion of FIG. 3 (wales W-4, W-5 and W-6). As illustrated, the yarns form stitch loops in the needle wales while the terry loops T are formed in the sinker wales and between the needle wales. In the sock illustrated in FIGS. 1 and 2, the terry loops T are also formed on the inner surface of the closed toe 13 and the lower portion of the instep 16, up to the dotted line 20.

The leg portion 10 and foot 12 are illustrated and described as being knit throughout with plain jersey stitches. However, other types of stitches can be formed in selected portions of the leg and/or foot 12. For example, elastic yarn may be inlaid with the body yarn to form either plain stitch or tuck stitch mock ribs in the leg and upper portion of the instep, in the manner disclosed in our co-pending application filed of even date herewith.

METHOD OF KNITTING

The dress weight tube sock of the present invention is knit on a fine gauge ladies' hosiery circular knitting machine normally provided with 400 latch needles of 75 gauge. There are many different types of fine gauge ladies' hosiery knitting machines presently in operation and the sock of the present invention can be knit on any of these types with very slight modifications. In the present instance, the sock will be described as being knit on an eight feed machine which has been modified to knit at four feeds. The needle cylinder of this machine normally rotates at 275 rpm and four courses are knit with each rotation of the needle cylinder. Thus, the production of this type of sock on a ladies' hosiery knitting machine is much faster than the knitting of either heavy weight or medium weight socks on men's hosiery circular knitting machines because these machines normally operate with the cylinder needle rotating at approximately 200 rpm and with only one or two knitting stations so that only one or two courses are knit with each rotation of the needle cylinder.

Figure 5:
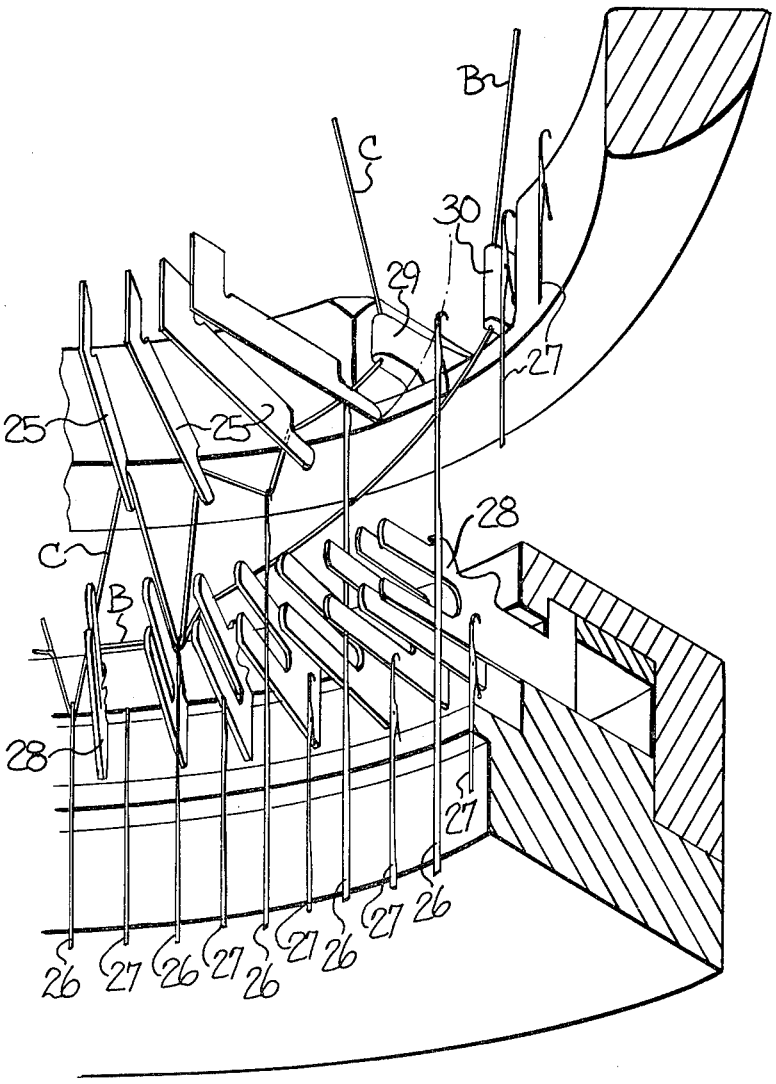
FIG. 5 is an enlarged, somewhat schematic isometric view showing some of the parts of the knitting machine adjacent one of the yarn feeding stations and illustrating the manner in which the terry loops are formed over the dial instruments.

The needle cylinder is continuously rotated throughout the knitting of the sock while the stretchable nylon body yarn B and the cotton auxiliary yarn C are both fed at each of the four knitting stations, in the manner illustrated in FIG. 5 at one knitting station. During the knitting of the leg portion 10, both yarns B and C are fed to and form knit stitch loops of both yarns on every other or alternative needles of the 400 needles in the machine while the remaining or intervening needles of the remaining 200 needles are maintained in an inactive or nonknitting position so that they are not raised to take yarn at the knitting stations. During the knitting of the leg portion, the yarns are drawn down by the active needles and between the active needles the yarns are drawn over adjacent pairs of sinkers and above an inactive needle. The yarns are knit in plated relationship in the needle wales so that the nylon body yarn B is plated to the outer surface of the sock to provide wear resistance while the cotton auxiliary yarn C is plated to the inner surface of the sock to provide the comfort of cotton against the foot. The nylon body yarn B is knit under greater tension than the cotton auxiliary yarn C and with sufficient tension that the stretchable body yarn B is elongated while being knit.

During the knitting of the heel area 17 and the instep area 16, dial instruments, indicated at 25 in FIG. 5, are mounted for radial movement in a dial, not shown, and are projected or moved outwardly at each knitting station and above the level of the sinkers 28 in those areas where terry loops are to be formed. A dial instrument 25 is aligned above each inactive needle, indicated at 27 in FIG. 5. The cotton auxiliary yarn C is fed through a feed finger 29 and is drawn over the terry loop forming step on the outer end of the dial instrument 25 and forms a terry loop of the cotton yarn as the active needles 26 on opposite sides thereof pick up both yarns and draw them down to stitch forming position.

The body yarn B is fed through a feed finger 30 and in advance of the cotton yarn C so that it does not pass over but is drawn down beneath the outer ends of the dial instruments 25 (FIG. 5). Thus, the body yarn B is drawn down by adjacent active needles 26 and over a pair of adjacent sinkers 28 and above an inactive needle 27, as illustrated in the left-hand portion of FIG. 5. The distance from the terry loop forming outer end of the dial instrument 25 down to the stitch forming ledge of the sinker 28 is on the order of about 5/16 of an inch so that the terry loops may be formed mucher longer, i.e., about 3 to 5 times longer, than could be formed if the terry loops were formed in the usual manner, over the nibs of the sinkers. This spacing of the terry loop forming outer end of the dial instrument 25 above the sinker 28 is adjustable to permit the length of the terry loops to be varied as desired and is sufficient that the terry loops may preferably be drawn at least five times as long as the stitch loops formed on the needles of the plated body yarn B and cotton auxiliary yarn C.

Thus, the relationship of the extra long terry loops to the relatively small fine gauge stitch loops is different from that in the conventional athletic sock where the terry loops approximate the size of the stitch loops. Here the body yarn loops are small and dressy in surface appearance, yet we are able to form terry loops of sufficient length to provide substantial comfort.

During the knitting of the heel area 17, dial instruments 25 are projected outwardly adjacent approximately 80 of the active needles 26 so that terry loops of the cotton yarn C are formed in 80 sinker wales. At the same time, the cotton yarn C does not form terry loops but is plated with the body yarn B in both the sinker and needle wales of the remaining 120 active needles. Thus, terry loop area in the heel 17 extends around slightly less than half the circumference of the sock while the instep area 16 extends around slightly more than half the circumference of the sock. Of course, the width of the heel area and the number of needles which knit the terry portion can be varied as desired.

The fragmentary view of the fabric shown in FIG. 3 clearly illustrates the manner in which the cotton auxiliary yarn C is plated with the body yarn B in the sinker wales between the needle wales W-1, W-2 and W-3, which are in the instep area 16. Also, the manner in which the cotton yarn C forms terry loops in the sinker wales between the needle wales W-3, W-4, W-5 and W-6 is clearly shown in FIG. 3, and these wales are in the heel area 17. While the terry loops in the sinker wales in the right-hand portion of FIG. 3 do not appear to be as long as the stitch loops in the needle wales, these terry loops extend away from the observer and the terry loops are shown in more nearly the correct proportion in FIG. 4 with the terry loops T being at least five times as long as the stitch loops formed of the plated cotton yarn C and body yarn B in wales W-4 and W-5 of FIG. 4.

Knitting of the foot portion of the sock continues with continuous rotation of the needle cylinder to form the upper portion of the sole 18, down to the dotted line 20 in the instep 16. At this point, all of the dial instruments 25 are moved outwardly at each knitting station to form terry loops of the cotton yarn C over the outer portions and form terry loops in both the lower portion of the instep 16 and the lower portion of the sole 18 so that terry loops are formed completely around the inside of this portion of the foot 12 of the sock. All of the dial instruments 25 also remain active during the knitting of the toe to form terry loops completely around the toe 13. When the knitting of the sock is completed, the toe end of the sock is open and the seam 14 is formed to close the toe.

By knitting the present sock on a ladies' fine gauge hosiery knitting machine, the yarns are actually knit on fine gauge needles (75 gauge) which are spaced much wider apart than is normal for this gauge needle. This wider than normal spacing of the needles is provided because every other needle remains in an inactive position (or the inactive needles can be removed from the machine). The present sock is knit on fine gauge needles which are spaced according to the spacing normally provided between the needles of a medium or coarse gauge machine. Thus, when initially formed, relatively short and narrow stitch loops are formed in each needle wale and the sinker wales are very wide. The stitch loops in the needle wales are spaced much wider apart than normal for this size of stitch loops because the sinker wales are formed by drawing the yarn down over a pair of adjacent sinkers which are positioned on each side of an inactive needle. One would normally assume that this type of knitting would produce an open, lacy or sleazy type of fabric. Surprisingly, however, this has not proved to be the case and the combination of the staple nonelastic yarn with the stretchable nylon yarn knit in accordance with this invention results in a sock having a very smooth, even, uniform appearance.

The abnormally wide sinker wales provide a greater than normal spacing between needle wales so that a greater proportional length of stretchable nylon body yarn extends in a coursewise direction when initially knit. The coursewise extending stretchable nylon body yarn can relax and contract with less restriction than would be possible if a stitch loop were formed in this space.

The plating of the cotton yarn C on the inner surface of the sock and the nylon body yarn B on the outer surface provides the absorption and comfort of cotton against the foot and leg of the wearer and provides the wear resistance characteristics of the nylon on the outer surface. The terry loops in the heel and sole areas provide a lightweight cushion which is very comfortable beneath the heel and foot of the wearer while the overall thickness, bulk, and weight of the sock is not sufficient to cause the foot to be uncomfortable or feel cramped in a dress shoe.

While body yarn B is disclosed as being multi-filament nylon, it is to be understood that other types of hydrophobic yarns may be used. Also, the auxiliary yarn C is disclosed as being a staple cotton or acrylic, however, it is to be understood that other types of hydrophilic yarns may be used.

In the drawings and specification there has been set forth a preferred embodiment of the invention, and although specific terms are employed, they are used in a generic and descriptive sense only, and not for purposes of limitation, the scope of the invention being defined in the claims.

That which is claimed is:

1. A dress weight tube sock having comfort characteristics of an athletic sock and being sufficiently light in weight and bulk to be worn with dress shoes, said tube sock including leg and foot portions said foot portion having a closed toe, an upper instep area, and lower heel and sole areas, said leg and foot portions being knit of a stretchable multifilament synthetic body yarn of about 100 to 200 denier and a nonstretchable auxiliary staple yarn of lighter weight knit in plated relationship with and on the inside of said body yarn throughout said leg portion and in at least a portion of said instep portion adjacent said heel area, and said auxiliary yarn being knit in plated relationship with said body yarn and forming terry loops in said heel and sole areas, and throughtout said closed toe and a portion of said instep adjacent said closed toe, and wherein said terry loops are from three to five times as long as the stitch loops formed of said body yarn.

2. A tube sock according to claim 1 wherein said stretchable synthetic body yarn is nylon, and wherein said nonstretchable auxiliary yarn is cotton yarn.

3. A tube sock according to claims 1 or 2 wherein said nylon body yarn is 140 denier, and wherein said cotton yarn is 50 single count.

* * * * *